US006006187A

United States Patent [19]

Tanenblatt

[11] Patent Number: 6,006,187

[45] **Date of Patent: *Dec. 21, 1999**

[54] COMPUTER PROSODY USER INTERFACE

[75] Inventor: Michael Abraham Tanenblatt, New York, N.Y.

[73] Assignee: Lucent Technologies Inc., Murray Hill, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,759

[22] Filed: Oct. 1, 1996

[51] Int. Cl.[6] ..... G10L 5/02

[52] U.S. Cl. ..... 704/260; 704/255; 704/261; 704/267

[58] Field of Search ..... 704/260, 235, 704/261, 255, 267, 268

[56] References Cited

U.S. PATENT DOCUMENTS

| | | | |
|---|---|---|---|
| 4,831,654 | 5/1989 | Dick | 395/2.69 |
| 4,979,216 | 12/1990 | Malsheen et al. | 395/2.69 |
| 5,384,893 | 1/1995 | Hutchins | 395/2.76 |
| 5,500,919 | 3/1996 | Luther | 395/2.69 |
| 5,615,300 | 3/1997 | Hara et al. | 395/2.69 |
| 5,642,466 | 6/1997 | Narayan | 395/2.69 |
| 5,652,828 | 7/1997 | Silverman | 395/2.69 |

*Primary Examiner*—David R. Hudspeth
*Assistant Examiner*—Vijay B. Chawan
*Attorney, Agent, or Firm*—Gibbons, Del Deo, Dolan, Griffinger & Vecchione

[57] ABSTRACT

The present invention discloses a computer prosody user interface operable to visually tailor the prosody of a text to be uttered by a text-to-speech system. The prosody user interface, permits users to alter a synthesized voice along one or more dimensions on a word-by-word basis. In one embodiment of the present invention, the prosody user interface is operable to alter the speaking rate relative word duration and the word prominence of a synthesized voice. Specifically, one or more words are selected using presentation means, and speech parameters corresponding to the speaking rate relative word duration and the word prominence are manipulated using speech parameter manipulation means. Modifications to the speech parameters are accompanied by visual changes to the presentation means, thereby providing a visual feel to the computer prosody user interface. To hear the modifications to the speech parameters, the present invention transmits a text string to a text-to-speech synthesizer program, wherein the text string comprises the text and escape sequences corresponding to the speech parameters set using the speech parameter manipulation means.

31 Claims, 5 Drawing Sheets

COMPUTER PROSODY USER INTERFACE

BACKGROUND OF THE INVENTION

1. Field of the Invention

The present invention relates to speech synthesizer systems, and more particularly to an interactive graphical user interface for controlling the acoustical characteristics of a synthesized voice.

2. Background of the Related Art

Most text-to-speech (TTS) systems allow users to alter the acoustical characteristics of a synthesized voice, thereby creating a new or modified synthesized voice. In text-to-speech systems, such as the well-known Bell Labs TTS system, the synthesized voice can be altered by manipulating speech parameters that control the acoustical characteristics of the synthesized voice. In the Bell Labs TTS system, the speech parameters are manipulated using escape sequences, which consist of ASCII codes that indicate to the Bell Labs TTS system the manner to alter one or more speech parameters. The following speech parameters are typically manipulable in a TTS system: pitch, rate, front and back head of the vocal tract, and aspiration.

By manipulating the speech parameters, acoustical characteristics of a base synthesized voice may be altered to create new voices or change intonations of utterances. To create specific voices or change the intonation of utterances, a user is often required to undergo a time consuming process of experimenting with various combinations of escape sequences corresponding to speech parameters before ascertaining whether a particular combination achieves the desired sound. Graphical user interfaces (GUIs) have been developed for TTS systems to facilitate this process of experimenting with various combinations of the escape sequences to create new voices.

Prior art TTS graphical user interfaces provide users with a mechanism for easy manipulation of speech parameters that control the acoustical characteristics of a synthesized voice, and creation or modification of a synthesized voice. Each word of a text subsequently converted into speech with the new or modified synthesized voice will possess the acoustical characteristics of the new or modified synthesized voice—that is, each word uttered by the synthesized voice will have the same pitch, rate, etc.

Human speakers often vary the acoustical characteristics of their voices such that certain words are emphasized or de-emphasized, perhaps giving different connotations to a phrase or sentence. The prior art TTS GUIs do not permit users to duplicate this human quality of tailoring the prosody of a text. Accordingly, there exist a need for a graphical user interface capable of permitting users to tailor the prosody of a text to be uttered by a text-to-speech system.

SUMMARY OF THE INVENTION

The present invention is directed to graphical user interfaces operable to visually tailor the prosody of a text to be uttered by a text-to-speech system. The graphical user interface of the present invention, also referred to herein as a prosody user interface (PUI), permits users to alter a synthesized voice along one or more dimensions on a word-by-word basis. In one embodiment of the present invention, the prosody user interface is operable to alter the speaking rate relative word duration and the word prominence of a synthesized voice. The present invention PUI comprises: presentation means for selecting words and punctuations of the text; speech parameter manipulation means operable to set speech parameters for selected words and punctuations presented by corresponding presentation means; and a transmitter for sending a text string to the text-to-speech system, wherein the text string includes the text to be uttered and escape sequences corresponding to the speech parameters set by the speech parameter manipulation means. The speech parameter manipulation means include prominence control means for setting the word prominence and duration control means for setting the speaking rate relative word duration of a word or punctuation in one or more selected presentation means. In another embodiment of the present invention, the speech parameter manipulation means include accent means for assigning accents to a word and phrase contour means for assigning phrase contours to the text.

Advantageously, the present invention PUI provides a visual "feel" regarding the speech parameters being set or assigned by a user. In one embodiment, the presentation means are redimensionable to correspond to the speech parameters set using the speech parameter manipulation means. Preferably, the horizontal and vertical dimensions of the presentation means correspond to the speaking rate relative word duration dimension set by the duration control means and the word prominence set by the prominence control means, respectively. Additionally, the accent means and the phrase contour means are preferably visually coordinated with the presentation means—that is, assigning an accent or a phrase contour to a word, punctuation or text will cause a visual change to the corresponding presentation means.

DESCRIPTION OF THE DRAWINGS

For a better understanding of the present invention, reference may be had to the following description of exemplary embodiments thereof, considered in conjunction with the accompanying drawings, in which.

DESCRIPTION

The present invention is a graphical user interface (GUI) for visually tailoring the prosody of a text to be uttered by a text-to-speech system. The graphical user interface of the present invention, also referred to herein as a prosody user interface (PUI), permits users to alter a synthesized voice along one or more dimensions. In one embodiment, the present invention PUI is operable to modify a synthesized voice along the speaking rate relative word duration and word prominence dimensions, as the terms are known in the art. It should not be construed, however, to limit the present invention to merely altering a synthesized voice along the aforementioned dimensions.

Figure 1:
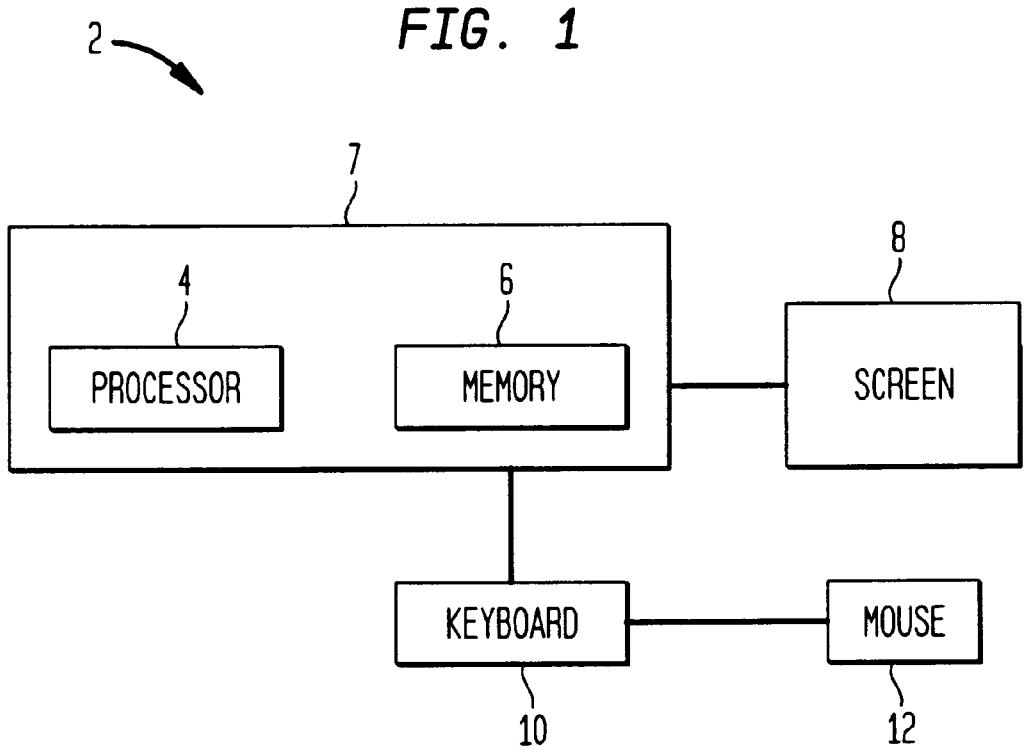
FIG. 1 depicts a text-to-speech system in accordance with one embodiment of the present invention.

Referring to FIG. 1, there is illustrated an embodiment of a text-to-speech system 02 in accordance with the present invention. As shown in FIG. 1, the text-to-speech system 02 comprises a processing unit 07, a screen 08, a keyboard 10 and a pointing device or computer mouse 12. The processing unit 07 includes a processor 04 and a memory 06. The computer mouse 12 includes switches 13 having a positive on and a positive off position for generating signals to the text-to-speech system 02. The screen 08, keyboard 10 and pointing device 12 are collectively known as the display. In the preferred embodiment of the invention, the text-to-speech system 02 utilizes UNIX® as the computer operating system and X Windows® as the windowing system for providing an interface between the user and a graphical user interface. UNIX and X Windows can be found resident in the memory 06 of the text-to-speech system 02 or in a memory of a centralized computer, not shown, to which the text-to-speech system 02 is connected. It should be understood that other computer operating systems and windowing systems, such as Windows NT, Windows 95, MacOS, etc., may also be used by the present invention.

X Windows is designed around what is described as client/server architecture. This term denotes a cooperative data processing effort between certain computer programs, called servers, and other computer programs, called clients. X Windows is a display server, which is a program that handles the task of controlling the display. Graphical user interfaces (GUI) are clients, which are programs that need to gain access to the display in order to receive input from the keyboard 10 and/or mouse 12 and to transmit output to the screen 08. X Windows provides data processing services to the GUI since the GUI cannot perform operations directly on the display. Through X Windows, the GUI is able to interact with the display. X Windows and the GUI communicate with each other by exchanging messages. X Windows uses what is called an event model. The GUI informs X Windows of the events of interest to the GUI, such as information entered via the keyboard 10 or clicking the mouse 12 in a predetermined area, and then waits for any of the events of interest to occur. Upon such occurrence, X Windows notifies the GUI so the GUI can process the data.

The prosody user interface can be found resident in the memory 06 of the text-to-speech system 02 or the memory of the centralized computer. The PUI provides an interactive means for facilitating the modification of the prosody of a text which is to be uttered by the TTS system. The PUI is preferably written in the Tcl-Tk language and operates with the standard windowing shell provided with the Tcl-Tk package. Tcl is a simple scripting language (its name stands for "tool command language") for controlling and extending applications. Tk is an X Windows toolkit which extends the core Tcl facilities with commands for building user interfaces having Motif "look and feel" in Tcl scripts instead of C code. Motif "look and feel" denotes the standard "look and feel" for X Windows as is known in the art and defined by Open Software Foundation®. Tcl and Tk are implemented as a library of C procedures so it can be used in many applications. Tcl and Tk are fully described by John K. Ousterhout in a 1994 publication entitled "Tcl and the Tk Toolkit" from Addison Wesley Publishing Company. Alternately, the prosody user interface can be written using other programming languages, such as C, C++, and Java.

In a preferred embodiment, the present invention utilizes UNIX's multitasking and pipe features to create an efficient PUI that provides effectively instant feedback for facilitating experimentation with the prosody of a text. The multitasking feature allows more than one application program to run concurrently on the same computer system, and the pipe feature allows the output of one process, i.e., running program, to be directly passed as input to another process. Specifically, the PUI uses a UNIX pipe to communicate with a concurrently running text-to-speech synthesizer program, such as the well-known Bell Labs text-to-speech synthesizer program, which can be found resident in the memory 06 of the text-to-speech system 02 or in the memory of the centralized computer.

The present invention PUI preferably sends a text string comprised of a series of escape sequences and text to be uttered via a UNIX pipe to the text-to-speech synthesizer process. The escape sequences are ASCII codes comprised of pairs of escape codes and associated speech parameter values. The escape codes and speech parameter values identify to the text-to-speech synthesizer process which speech parameters are to be set and the values to be assigned to each of the speech parameters, respectively. Upon receipt of the text string, the text-to-speech synthesizer will convert the text to speech using a base synthesized voice altered according to the escape sequences. Through the PUI, users are able to explore combinations of speech parameters that would normally be time consuming if they were provided as manual input to the text-to-speech synthesizer process. The fact that the user is actually manipulating the escape sequences is entirely transparent.

Figure 2:
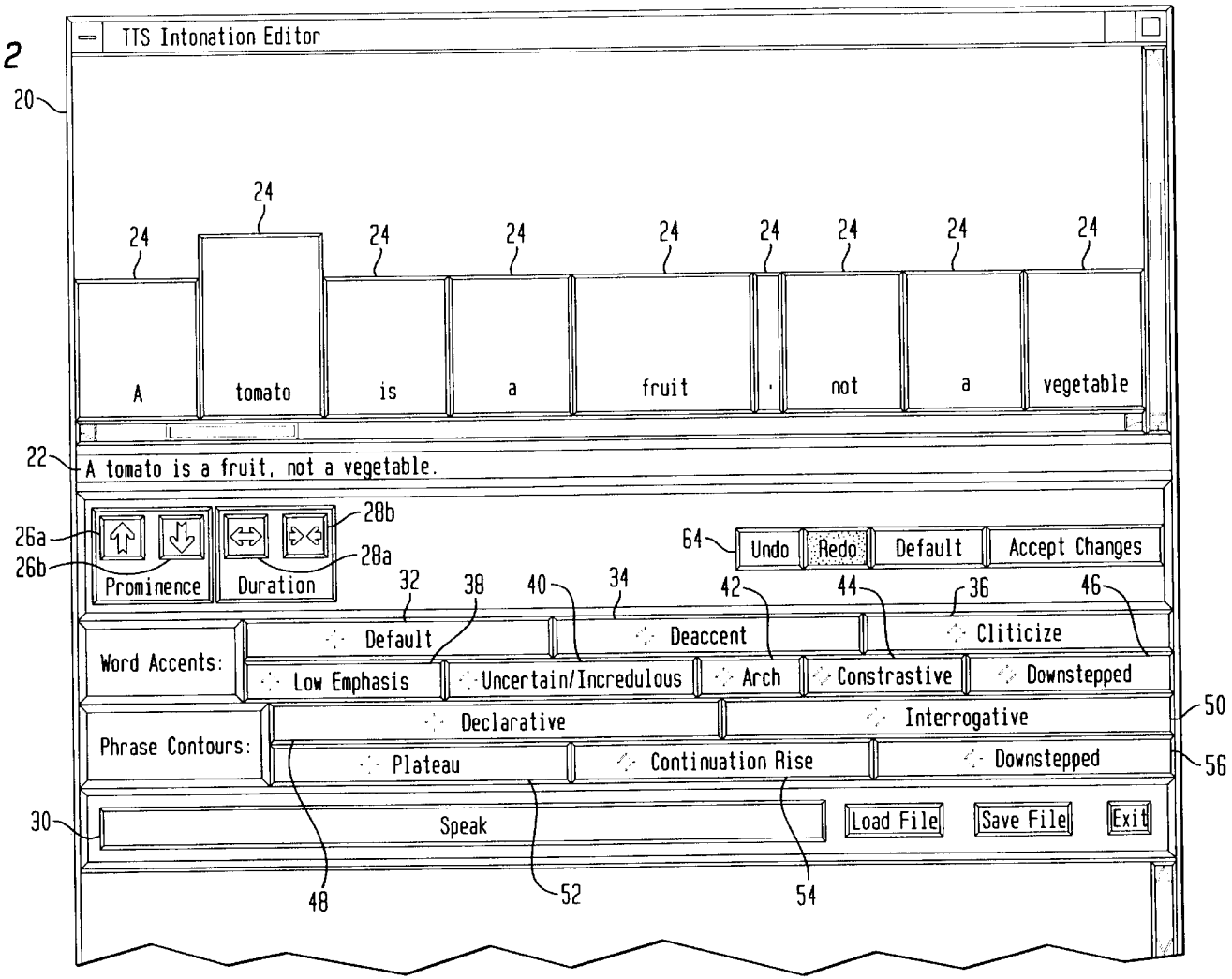
FIG. 2 depicts an exemplary illustration of a prosody user interface.

Referring to FIG. 2, there is shown an exemplary illustration of a PUI 20 in accordance with the present invention. The PUI 20 is a mechanism which permits users to alter a synthesized voice along two speech dimensions: speaking rate relative word duration and word prominence (or pitch). As shown in FIG. 2, the PUI 20 includes a text entry box 22, presentation means or word boxes 24, speech parameter manipulation means, such as prominence buttons 26*a,b* and duration buttons 28*a,b*, and a speak button 30. A user enters the text to be uttered in the text entry box 22. The PUI subsequently transposes the text to be uttered into the word boxes 24. Each word and punctuation of the text is presented within its own word box 24. To modify the speaking rate relative word duration and/or word prominence of a word or punctuation, the user must first select one or more words or punctuations to modify by clicking on the appropriate word boxes with the computer mouse preferably causing the word boxes to be highlighted.

The speaking rate relative word duration dimension can be modified using the duration buttons 28*a,b*, i.e., the duration of a word or punctuation is increased by clicking on the duration button 28*a* or decreased by clicking on the duration button 28*b*. Likewise, the word prominence dimension can be modified using the prominence buttons 26*a,b*, i.e., the prominence of a word is increased by clicking on the prominence button 26*a* or decreased by clicking on the prominence button 26*b*. Note that a punctuation may not be changed along the word prominence dimension since punctuations are not associated with word prominence, For the purposes of this application, the present invention will be described herein with respect to the Bell Labs text-to-speech synthesizer program. It should not be construed, however, to limit the present invention in any manner. With respect to the Bell Labs text-to-speech synthesizer program, the escape sequences for modifying the word prominence and speaking rate relative word duration dimensions includes "!*N" and "!rN," respectively, where "N" is a floating point number or speech parameter value which is used to multiply the word or punctuation's default prominence or rate. Thus, the prominence and duration buttons 26*a,b*, 28*a,b* are operable to change or set the value of "N" for the escape sequences relating to the word prominence and speaking rate relative word duration dimensions, respectively.

Advantageously, the PUI 20 provides a visual "feel" regarding the current speaking rate relative word duration and word prominence dimensions for each word and punctuation of the text. Initially, each word box 24 is the same size indicating to users that each word and punctuation will be uttered with the same speaking rate relative word duration and word prominence. The word boxes 24 may be stretched or shortened along their horizontal axes to indicate that the duration of the corresponding words and punctuations have been increased or decreased, respectively. Likewise, the word boxes 24 may be heightened or shortened along their vertical axes to indicate that the prominence of the corresponding words have been increased or decreased, respectively. Thus, a word box 24 stretched along its horizontal axis, such as the word "fruit," will have a longer speaking rate relative word duration than other words within the text, and a word box 24 heightened along its -s vertical axis, such as the word "tomato," will have a relatively higher pitch than other words within the text. Preferably, the dimensions of the word boxes are mathematically related, e.g., proportional, exponentially, etc., to the speaking rate relative word duration and the word prominence dimensions. In a preferred embodiment of the present invention, the word boxes can also be re-dimensioned by "dragging" the edges or corners of the word boxes to the desired proportions, thereby causing the value of "N" to be appropriately changed.

In an alternate embodiment, text can be loaded from a file into the text entry box 22 and subsequently transposed into the word boxes 24. Any relevant escape sequences which appear in the file are applied when transposing the text into the word boxes 24. Additionally, text can also be saved to a file with all the escape sequences inserted in the appropriate places.

Figure 3:
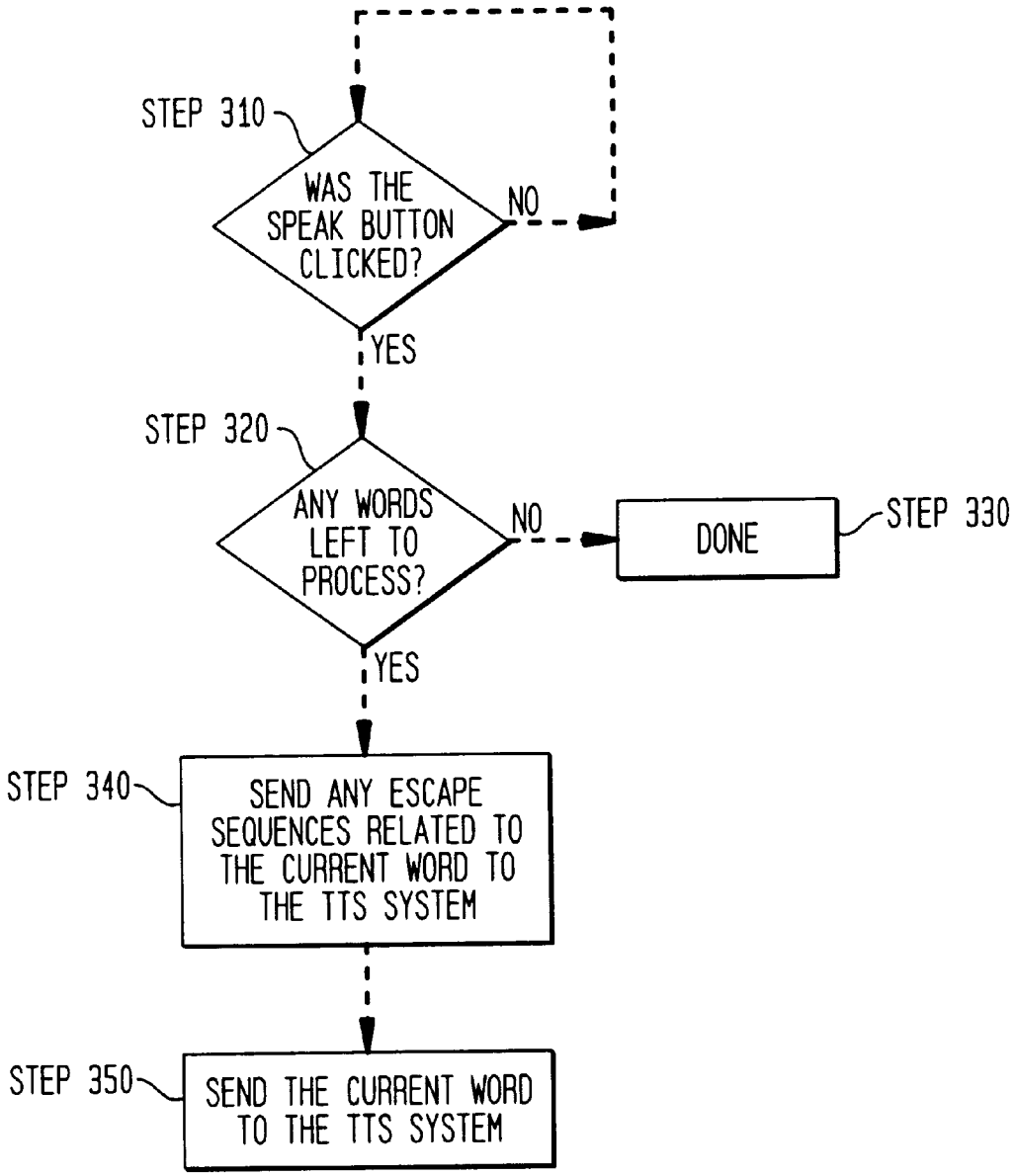
FIG. 3 depicts an exemplary flowchart illustrating the sequence of steps utilizes by the prosody user interface for processing data to a text-to-speech synthesizer process.

To hear the affects of the modifications, the user clicks on the speak button 30 which will cause a text string to be transmitted to a TTS synthesizer process, thereby causing the text to be uttered by the text-to-speech system. Referring to FIG. 3, there is illustrated a flowchart 300 illustrating the sequence of steps utilizes by the PUI 20 for transmitting a text string to the text-to-speech synthesizer process. As shown in FIG. 3, the PUI, in step 310, checks if a user clicked on the speak button 30. If the speak button was not clicked on, the PUI loops back to step 310. Otherwise the PUI begins to individually processes the words of the text from left to right. Specifically, in step 320, the PUI 20 checks if there are any words left to process. If there are no more words to process, the PUI 20 goes to step 330 where it stops. Otherwise the PUI 20 proceeds to step 340 where any escape sequences related to the current word are sent to the text-to-speech synthesizer process. Recall that the escape sequences are determined using the value of "N" set by the prominence and/or duration buttons 26*a,b*, 28*a,b*. Subsequently, in step 350, the current word is sent to the text-to-speech synthesizer process and control is returned to step 330.

Note that the Bell Labs text-to-speech synthesizer program assumes that each word possesses the default word prominence and the speaking rate relative word duration of the previous word. Thus, the flowchart 300 would need to perform the following sub-steps in step 340 with respect to the Bell Labs text-to-speech synthesizer program: check if the word prominence for the current word is different from the default word prominence and, if yes, transmit the appropriate escape sequence; and check if the speaking rate relative word duration for the current word is different from the speaking rate relative word duration for the previous word and, if yes, transmit the appropriate escape sequence. Further note that the PUI 20 re-sets the speaking rate relative word duration to the default (or another) speaking rate relative word duration if the succeeding word has a different speaking rate relative word duration.

In one embodiment of the present invention, the PUI 20 includes additional speech parameter manipulation means for assigning specific accents to words and manipulating phrase contours. For example, as shown back in FIG. 2, the PUI 20 further includes accent buttons 32, 34, 36, 38, 40, 42, 44, 46 for assigning the following accents, respectively, as the terms are known in the art: default, de-accent, cliticize, low emphasis, uncertain/incredulous, arch, contrastive, and downstep accents. In a preferred embodiment, the accent buttons 32, 34, 36, 38, 40, 42, 44, 46 are visually coordinated with the word boxes 24 such that, when activated, the word boxes 24 will have a visual change associated preferably reflecting the accent button. For example, activating any of the accent buttons might cause the selected word box to change colors, add underlines, add outlines, etc. Suppose the low emphasis button 38 has a green background. If a word was to be assigned a low emphasis accent, then the background of the corresponding word box will change to green to visually indicate that a low emphasis accent has been assigned to the corresponding word.

The PUI 20 may further include, for example, phrase contour buttons 48, 50, 52, 54, 56 for assigning the following phrase contours to the text, respectively: declarative, interrogative, plateau, continuation rise, and downstepped. Like the accent buttons 32, 34, 36, 40, 42, 44, 46, the phrase contour buttons 48, 50, 52, 54, 56 are also preferably visually coordinated with the word boxes 24.

With respect to Bell Labs text-to-speech synthesizer program, accents are assigned to a word using the following escape sequences: low emphasis "\!*L*"; uncertain/incredulous "\!*L*+H"; arch "\!*H+L*"; contrastive "\!*L+H*"; downstepped "\!* \!@"; deaccent "\!-"; and cliticize "\!c". These accent escape sequences are transmitted to the TTS synthesizer process in step 340 of the flowchart 300.

Figure 4:
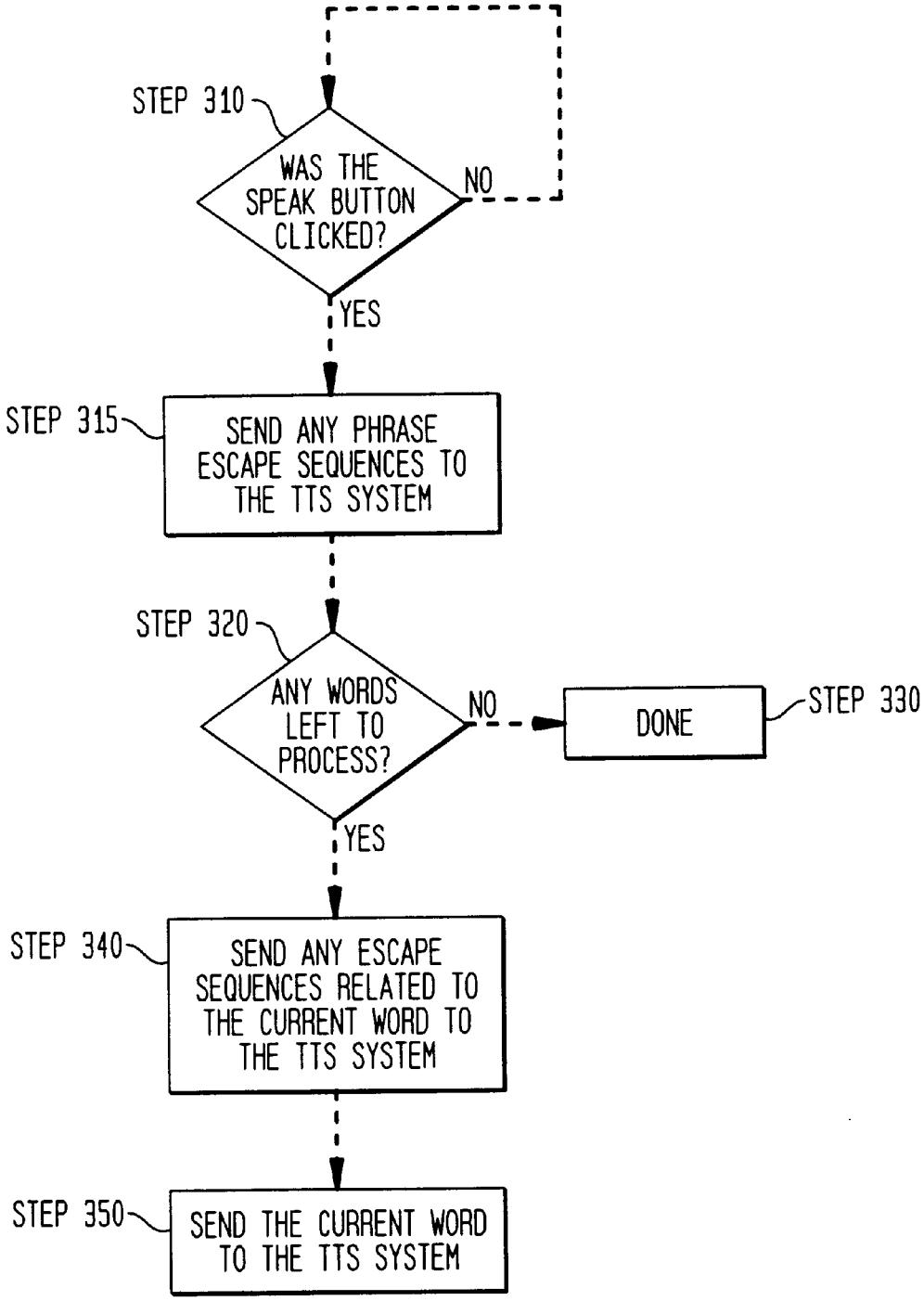
FIG. 4 depicts the flowchart of FIG. 3 having an additional step for transmitting any escape sequences relating to phrase contours to the text-to-speech synthesizer process.

Likewise, phrase contours are assigned to the text using the following escape sequences: interrogative "\!pH1 \!bH1"; plateau "\!pH1 \!bL1"; continuation rise "\!pL1 \!bH2"; and downstepped "\!_ \!{K0.6". Default accents and declarative phrase contours are assigned by removing any escape sequences relating to accents and phrase contours, respectively. Referring to FIG. 4, there is illustrated the flowchart 300 having an additional step 315.

As shown in FIG. 4, the flowchart 300 transmits any escape sequences relating to phrase contours to the TTS synthesizer process in step 315 to manipulate the contour of the text being uttered.

Figure 5:
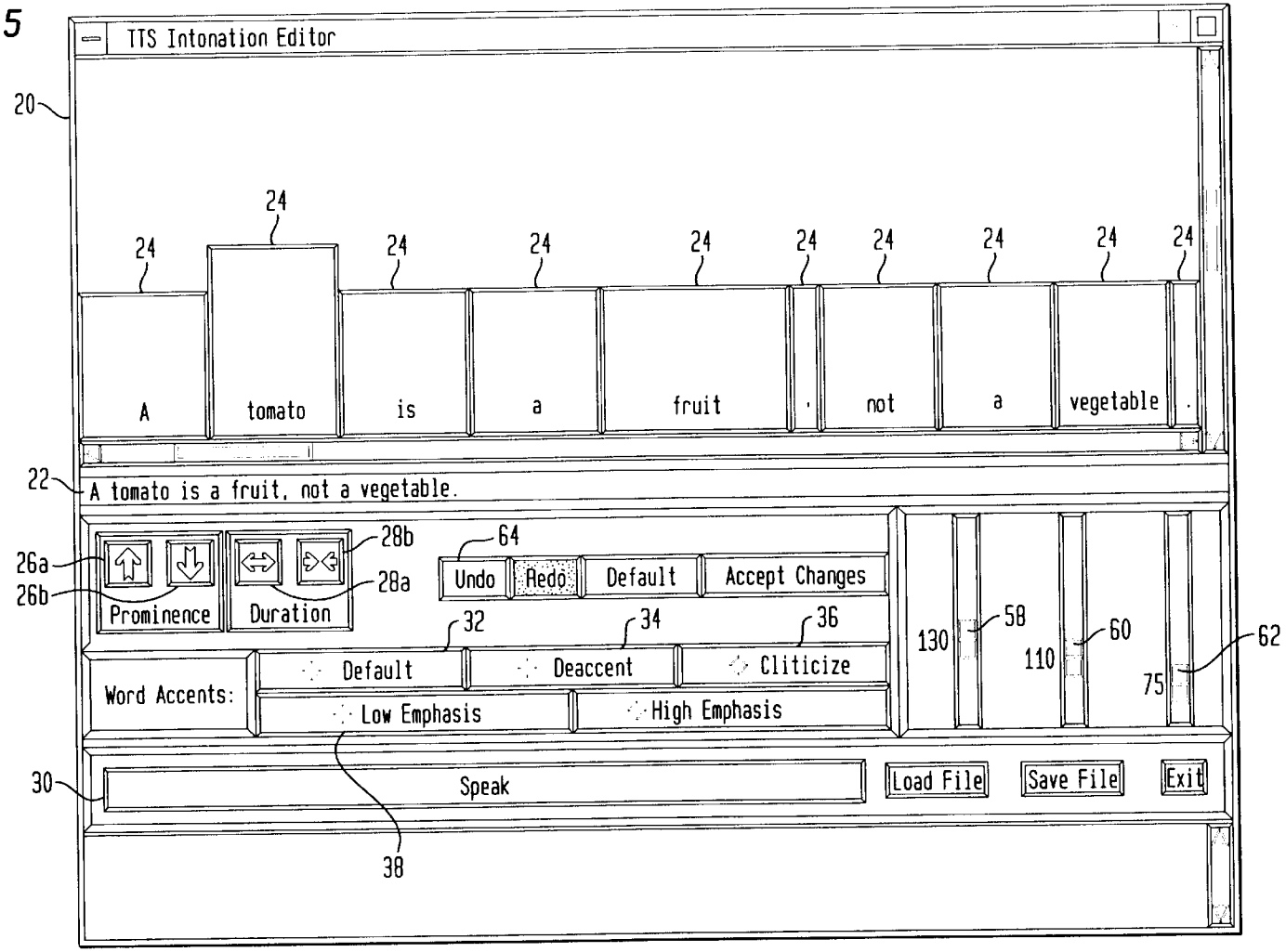
FIG. 5 depicts an exemplary illustration of another prosody user interface.

In an alternate embodiment of the present invention, the overall phrase curve may be modified using sliders. Referring to FIG. 5, there is illustrated a PUI 20 having sliders 58, 60, 62. As shown in FIG. 5, the first slider 58 controls the initial frequency of the phrase being uttered, the second slider 60 controls the initial frequency of the final accent group, and the third slider 62 controls the final frequency of the phrase.

The PUI 20 may further include an unlimited undo feature for allowing any changes that are made to be reversed, thus giving the user freedom to explore various alternatives while retaining the ability to return to the previous state. As shown back in FIG. 2, the undo feature may be activated by clicking on the undo button 64.

Although the present invention has been described in considerable detail with reference to certain embodiments, operating systems and text-to-speech systems, other embodiments, operating systems and text-to-speech systems are also applicable. Therefore, the spirit and scope of the appended claims should not be limited to the description of the embodiments, operating systems and text-to-speech systems contained herein.

I claim:

1. In a system for converting text to voiced speech, an interface means operable to permit a user to alter a prosody characteristic of a synthesized voice for particular words of said text, said interface means comprising:

means for selecting one or more words and punctuation in text input to said system;

display means operable to provide a visual display of said selected one or more words including an indicia of change in at least one prosody characteristic for said displayed words;

means, operating in conjunction with said display means, for enabling a user to dynamically effect a change in said at least one prosody characteristic for at least one of said displayed words; and means for applying said changed prosody characteristic to a voiced output of said at least one of said displayed words as to which said changed prosody characteristic is effected.

2. The interface means of claim 1, wherein a change in said indicia of change along a first dimension is indicative of a change in a first prosody characteristic for a selected word and a change in said indicia of change along a second dimension is indicative of a change in a second prosody characteristic for said selected word.

3. The interface means of claim 2, wherein horizontal dimensions of said indicia of change correspond to speaking rate relative word duration of said selected words.

4. The interface means of claim 2, wherein horizontal dimensions of said indicia of change correspond to speaking rate relative word duration of said selected punctuations.

5. The interface means of claim 2, wherein vertical dimensions of said indicia of change correspond to word prominence of said selected words.

6. The interface means of claim 1, wherein said means for enabling includes a means for redimensioning said indicia of change in said display means, said redimensioning manifesting a correspondence with changes made in said at least one prosody characteristic.

7. The interface means of claim 1, wherein said means for enabling is operable to effect a redimensioning of said indicia of change for a selected word, said redimensioning corresponding to a change in said at least one prosody characteristic.

8. The interface means of claim 1, wherein said indicia of change in said display means is visually coordinated with changes in said at least one prosody characteristic effected by said means for enabling.

9. The interface means of claim 1, wherein said means for enabling includes:

duration control means for setting speaking rate relative word duration of selected words to be uttered by said synthesized voice.

10. The interface means of claim 1, wherein said means for enabling includes:

duration control means for setting speaking rate relative word duration dimension of selected punctuations.

11. The interface means of claim 1, wherein said means for enabling includes:

prominence control means for setting word prominence of selected words to be uttered by said synthesized voice.

12. The interface means of claim 1, wherein said means for enabling includes:

accent means for assigning accents to selected words, said selected accents being assigned using escape sequences.

13. The interface means of claim 12, wherein said accent means have active and deactive positions, said accent means causing visual changes to said indicia of change when said accent means are in said active positions.

14. The interface means of claim 13, wherein said visual changes to said indicia of change upon said accent means being in said active position is manifested as a change in background color for said selected word.

15. The interface means of claim 1, wherein said means for enabling includes:

phrase contour means for assigning phrase contours to portions of said text, said phrase contours being assigned using escape sequences.

16. The interface means of claim 1, wherein said means for applying includes:

creation means for forming a text string using said selected words and prosody characteristics therefor as established by said means for enabling.

17. The interface means of claim 1, wherein said means for applying includes: comparison means for relating prosody characteristics of a current word with prosody characteristics of a previous word.

18. The interface means of claim 1, wherein said means for applying includes: comparison means for relating prosody characteristics of a current word with default prosody characteristics.

19. A method for altering a prosody characteristic of a synthesized voice in a text to speech system comprising the steps of:

selecting one or more words and punctuation in text input to said text-to-speech system;

providing a visual display to a user of said selected one or more words, said display including an indicia of change in at least one prosody characteristic for said displayed words;

providing a user interface to said display, whereby a user to able to dynamically alter said at least one prosody characteristic for at least one of said displayed words; and applying said altered prosody characteristic to a voiced output of said at least one of said displayed words.

20. The method for altering a prosody characteristic of claim 19 further comprising the additional steps of:

causing a change in said indicia of change along a first dimension to correspond with a change in a first prosody characteristic for a selected word; and causing a change in said indicia of change along a second dimension to correspond with a change in a second prosody characteristic for said selected word.

21. The method for altering a prosody characteristic of claim 20, wherein horizontal dimensions of said indicia of change correspond to speaking rate relative word duration of said selected words.

22. The method for altering a prosody characteristic of claim 20, wherein horizontal dimensions of said indicia of change correspond to speaking rate relative word duration of said selected punctuations.

23. The method for altering a prosody characteristic of claim 20, wherein vertical dimensions of said indicia of change correspond to word prominence of said selected words.

24. The method for altering a prosody characteristic of claim 19, wherein said user interface includes a means for redimensioning said indicia of change in said display means, said redimensioning manifesting a correspondence with changes made in said at least one prosody characteristic.

25. The method for altering a prosody characteristic of claim 19, wherein said user interface is operable to effect a redimensioning of said indicia of change for a selected word, said redimensioning corresponding to a change in said at least one prosody characteristic.

26. The method for altering a prosody characteristic of claim 19, wherein said indicia of change is visually coordinated with changes in said at least one prosody characteristic.

27. The method for altering a prosody characteristic of claim 19, wherein said user interface includes an accent means for causing accents to be assigned to selected words, said accents being assigned using escape sequences.

28. The method for altering a prosody characteristic of claim 27, wherein said accent means has active and deactive positions, and is operative to cause visual changes to said indicia of change when said accent means is in said active positions.

29. The method for altering a prosody characteristic of claim 19, wherein said step of applying includes a substep of:

forming a text string using said selected words and prosody characteristics therefor.

30. The method for altering a prosody characteristic of claim 19, wherein said step of applying includes a substep of:

relating prosody characteristics of a current word with prosody characteristics of a previous word.

31. The method for altering a prosody characteristic of claim 19, wherein said step of applying includes a substep of:

relating prosody characteristics of a current word with default prosody characteristics.

* * * * *